US008815068B2

(12) United States Patent
Anekal

(10) Patent No.: US 8,815,068 B2
(45) Date of Patent: Aug. 26, 2014

(54) MIXING METHOD AND SYSTEM FOR INCREASED COALESCENCE RATES IN A DESALTER

(75) Inventor: Samartha G. Anekal, San Jose, CA (US)

(73) Assignee: Phillips 66 Company, Houston, TX (US)

( * ) Notice: Subject to any disclaimer, the term of this patent is extended or adjusted under 35 U.S.C. 154(b) by 506 days.

(21) Appl. No.: 13/274,807

(22) Filed: Oct. 17, 2011

(65) Prior Publication Data

US 2012/0097542 A1 Apr. 26, 2012

Related U.S. Application Data

(60) Provisional application No. 61/406,247, filed on Oct. 25, 2010.

(51) Int. Cl.

| | |
|---|---|
| ***C10G 33/02*** | (2006.01) |
| ***B01D 17/06*** | (2006.01) |
| ***C10G 32/02*** | (2006.01) |
| ***C10G 53/04*** | (2006.01) |
| ***C10G 21/08*** | (2006.01) |
| ***C10G 21/30*** | (2006.01) |

(52) U.S. Cl.

CPC ..... *C10G 21/08* (2013.01); *C10G 2300/1033* (2013.01); *C10G 53/04* (2013.01); *C10G 2300/805* (2013.01); *C10G 21/30* (2013.01); *C10G 33/02* (2013.01)

USPC ..... 204/570; 208/187; 204/559; 204/561; 204/563

(58) Field of Classification Search

USPC ..... 208/187, 188; 204/559–570

See application file for complete search history.

(56) References Cited

U.S. PATENT DOCUMENTS

| | | | | |
|---|---|---|---|---|
| 3,527,697 | A | | 9/1970 | Watson |
| 3,855,103 | A | * | 12/1974 | McLaren et al. ..... 204/662 |
| 4,684,457 | A | | 8/1987 | McKechnie et al. |
| 4,722,781 | A | | 2/1988 | Swartz et al. |
| 6,228,239 | B1 | | 5/2001 | Manalastas et al. |
| 2008/0251421 | A1 | | 10/2008 | Liverud et al. |
| 2009/0242384 | A1 | | 10/2009 | Curcio et al. |
| 2010/0038286 | A1 | | 2/2010 | Greaney et al. |

OTHER PUBLICATIONS

Boxall, et al., "Measurement and Calibration of Droplet Size Distributions in Water-in-Oil Emulsions by Particle Video Microscope and a Focused Beam Reflectance Method", Ind. Eng. Chem. Res. 2010, 49, 1412-1418.

Agar, et al., "Energy Absorption Probes Control Oily-Water Discharges", Hydrocarbon Processing Magazine, Aug. 1993, p. 55-59.

Goldsman, et al. "Output Analysis Procedures for Computer Simulations", In Proceedings of the 32nd Conference on Winter Simulation, p. 39-45, 2000.

Zhang, et al., "Theoretical Prediction of Electric Field-Enhanced Coalescene of Spherical Drops," AIChE Journal 1995, vol. 41(7), p. 1629-1639.

(Continued)

*Primary Examiner* — Randy Boyer

(74) *Attorney, Agent, or Firm* — Phillips 66 Company

(57) ABSTRACT

The present invention relates to crude oil-water separation processes, specifically desalting in a petroleum refinery. More particularly, the present invention relates to a method and system for increase coalescence rates of water drops in a desalter.

6 Claims, 1 Drawing Sheet

(56) References Cited

OTHER PUBLICATIONS

Berry, et al., An Analysis of Cloud Drop Growth by Collection: Part I. Double Distributions, Journal of the Atmospheric Sciences, 1974. 31(7): p. 1814-1824.

Panoussopoulos, K., "Separation of Crude Oil-Water Emulsions: Experimental Techniques and Models", Diss. ETH No. 12516, 1996.

Woodside, A.B., Desalting 101, 2009: Ponca City, OK.

* cited by examiner

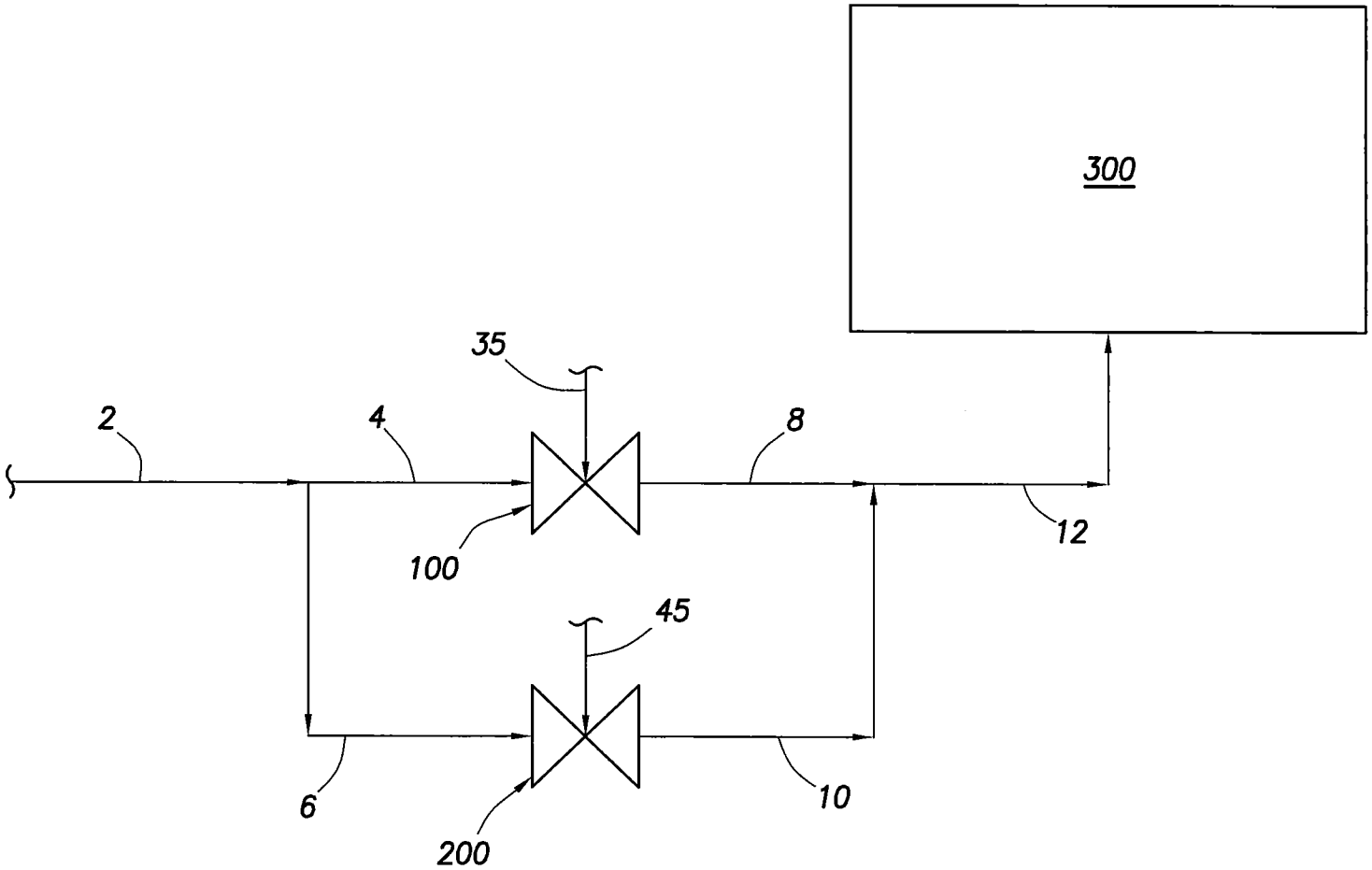
300
12
8
10
35
45
100
200
4
6
2

MIXING METHOD AND SYSTEM FOR INCREASED COALESCENCE RATES IN A DESALTER

CROSS-REFERENCE TO RELATED APPLICATIONS

This application claims priority benefit under 35 U.S.C. Section 119(e) to U.S. Provisional Patent Ser. No. 61/406,247 filed on Oct. 25, 2010, the entire disclosure of which is incorporated herein by reference.

FIELD OF THE INVENTION

The present invention relates to crude oil-water separation processes, specifically desalting in a petroleum refinery. More particularly, the present invention relates to a method and system for increase coalescence rates of water drops in a desalter.

BACKGROUND OF THE INVENTION

Desalting is the first process crude oil undergoes in a refinery. The primary purpose of desalting is to remove mineral salts present in crude oil, along with solids, metals, and water. Salts, mostly chlorides of sodium, potassium, and calcium naturally occur in soil and are associated with produced crude oil. Most of the salt is present as dissolved salt, in a small amount of water also associated with the crude oil. When this crude oil enters the refinery, it is necessary to remove these salts. Incomplete removal of salts can cause several problems, ranging from fouling and corrosion in heat exchangers and columns to catalyst poisoning.

Prior to entering the desalter vessel, crude oil is contacted with wash water by passing the two through a mixing valve. As a result, salt present in the crude oil is mixed with, and dissolved in the wash water. The mixing process also creates an emulsion of water drops in oil, which must be separated in order to remove the dissolved salt. This is accomplished in a desalter vessel, where the emulsion flows in at very slow velocities. An electric field in the desalter vessel promotes collision between drops, which leads to the formation of larger drops. When drops are sufficiently large, gravity forces the drops to settle to the bottom of the desalter vessel. Thus, the desalter vessel can be considered a gravity-based separation device, enhanced by the application of eclectic fields. In addition, chemicals may be added to promote drop coalescence.

With refineries increasingly processing more heavy crude oil, consistent desalting has become a challenge. The high density and viscosity of heavy crude oil, and its ability to form highly stable water-in-oil emulsions are mainly responsible for this inconsistent performance. Due to economic implications of poor desalting processes, it has become necessary to closely examine the fundamentals of the desalting process to investigate possible modifications. The fundamental process of water removal in a desalter vessel is the settling of water drops due to buoyant forces, which strongly depend on the size of the droplet. Thus, an important component of desalting is promoting drop-drop collisions, which result in the formation of larger drops.

Currently, optimization of desalter mixing is done primarily empirically, by tracing the performance of the desalter against mixing intensity usually controlled via the pressure drop across the mixing valve. Although there are some general principles on selecting the optimum pressure drop, there are no other controls used to alter mixing characteristics. This limits current desalting operation to the range of mixing produced by a single mixing valve.

Therefore, a need exists for a method and a system for increased coalescence rates in a desalter.

SUMMARY OF THE INVENTION

In an embodiment, a method for reducing a salt content of crude oil includes: (a) dividing the crude oil stream into a first stream and a second stream; (b) mixing the first stream with a wash water stream resulting in a first oil/water stream; (c) mixing the second stream with a wash water stream resulting in a second oil/water stream; (d) combining the first oil/water stream and the second oil/water stream resulting in a mixed oil/water stream; (e) routing the mixed oil/water stream to a separator vessel whereby at least a substantial portion of the salt content is absorbed by water in the mixed oil/water stream; (f) electrostatically treating the mixed oil/water stream in the separator vessel; (g) extracting water from a lower portion of the separator vessel; and (h) extracting treated oil from an upper portion of the separator vessel.

In another embodiment, a method for reducing a salt content of crude oil includes: (a) dividing the crude oil stream into a first stream and a second stream; (b) routing the first stream to a first mixing valve, wherein the first stream is mixed with a wash water stream resulting in a first oil/water stream, wherein the first mixing value has a low pressure drop resulting in large drops of water in oil; (c) routing the second stream to a second mixing valve, wherein the second stream is mixed with a wash water stream resulting in a second oil/water stream, wherein the second mixing valve has a high pressure drop resulting in a small drops of water in oil; (d) combining the first oil/water stream and the second oil/water stream resulting in a mixed oil/water stream; (e) routing the mixed oil/water stream to a separator vessel whereby at least a substantial portion of the salt content is absorbed by water in the mixed oil/water stream; (f) electrostatically treating the mixed oil/water stream in the separator vessel; (g) extracting water from a lower portion of the separator vessel; and (h) extracting treated oil from an upper portion of the separator vessel.

In yet another embodiment, a system for desalting hydrocarbons includes: (a) a crude oil stream; (b) a means for dividing the crude oil stream into a first stream and a second stream; (c) a first mixing valve for mixing the first stream and a wash water stream resulting in a first oil/water stream, wherein the first mixing vales has a low pressure drop; (d) a second mixing valve for mixing the second stream and a wash water stream resulting in a second oil/water stream, wherein the second valve has a high pressure drop; (e) a means for combining the first oil/water stream and the second oil/water stream resulting in a mixed oil/water stream; and (f) a separator located downstream of the mixed oil/water stream, wherein the separator electrostatically treats the mixed oil/water stream.

BRIEF DESCRIPTION OF THE DRAWINGS

The invention, together with further advantages thereof, may best be understood by reference to the following description taken in conjunction with the accompanying drawings in which:

FIG. 1 is a schematic drawing of desalting equipment in accordance with an embodiment of the present invention.

DETAILED DESCRIPTION OF THE INVENTION

Reference will now be made in detail to embodiments of the present invention, one or more examples of which are illustrated in the accompanying drawings. Each example is provided by way of explanation of the invention, not as a limitation of the invention. It will be apparent to those skilled in the art that various modifications and variations can be made without departing from the scope or spirit of the invention. For instance, features illustrated or described as part of one embodiment can be used on another embodiment to yield a still further embodiment. Thus, it is intended that the present invention cover such modifications and variations that come within the scope of the appended claims and their equivalents.

Desalting of crude oil is accomplished by injecting 5% to 6% wash water into the crude oil, thoroughly mixing the wash water and crude oil, and then providing efficient separation of the two phases. The emulsification or washing step is accomplished primarily through a mixing valve which causes emulsion formation due to the high energy dissipation (pressure drop) across the valve. Separation of the water from the crude oil is accomplished in a "desalter" which is a pressure vessel. The normal gravity separation of water from the crude oil in the vessel is accelerated with the use of an electrical field, heat, and emulsion breaking chemicals.

Wash water may be injected simultaneously with the crude oil into the mixing valve or injected into the system ahead of the mixing valve. As used herein, "wash water" is fresh water that "washes" salt out of the oil. The wash water is intended to include any water which has a sufficiently low content of sodium ion. Generally, the wash water will be municipal water from a river or other non-brackish water source. Many crudes contain dissolved calcium carbonate and other salts in the brine which exhibit inverse solubility. As the temperature of the crude oil increases, these salts can precipitate from solution and form a heavy scale in the preheat exchangers. This scaling reduces heat transfer; increases exchanger cleaning costs, and can limit crude oil unit capacity. Adding wash water ahead of the preheat exchangers reduces the scaling tendencies of these compounds by diluting the scale forming salts. Wash water will also help remove some particulate solids that may foul the exchanger.

The amount of wash water used depends on the characteristics of the crude oil and the capabilities of the equipment in the unit. Occasionally the wash water rate is limited by the availability of suitable wash waters or by environmental constraints on the amount or quality of waste water leaving the plant.

If too little wash water is used, desalting efficiency can be reduced. This is because the water droplets in the emulsion formed by the mixing valve will be too far apart to collide with other droplets and coalesce in the electrical field. The result is less water removed from the crude. There is also less of a dilution effect on the brine that does remain in the crude oil.

If too much wash water is used, the resulting emulsion can become conductive enough to cause current to flow between the grids, with a resulting decrease in voltage gradient. This reduces the driving force for droplet polarization, coalescence in the electrical field, and reduces desalting efficiency.

The mixing valve is designed to provide enough shear energy to overcome the oil/water interfacial surface tension and ensure thorough contact between the wash water and the crude oil. This is accomplished by the energy dissipation (pressure drop or $\Delta P$) taken across the valve. The higher the pressure drop the greater the mixing energy and the smaller the water droplets become.

Mixing valve pressure drop is an important operating parameter in the desalting system. The pressure drop or energy input directly affects the washing efficiency and the ability to separate water and oil in the desalting vessel. If the mixing valve $\Delta P$ is too low, the contact between wash water and crude oil will be insufficient to achieve adequate desalting and solids removal. If the $\Delta P$ is too high, the water will be emulsified into the crude oil to such a degree that it becomes difficult to separate the oil and water phases in the desalter. Again, desalting efficiency is reduced and more oil can be present in the brine.

Referring to FIG. 1, a crude oil stream 2 containing water, salts, silts, clays and other inorganic materials enters the refining process and is divided into a first stream 4 and a second stream 6. Each stream is delivered to an individual mixing valve. The mixing valve is a type well-known in the art. In an embodiment, the mixing valve is a single port globe valve. Alternately, other types of mixing valves such as, for example, a double port globe valve can be used. The purpose of the mixing valve is to mix a portion of the crude oil stream with a wash water stream.

The first stream 4 is mixed with a wash water stream 35 in the first mixing valve 100 resulting in a first oil/water stream 8. In an embodiment, the first mixing valve has a low pressure drop. The actual pressure drop depends on crude oil and water properties. But the specific intention of the low pressure drop operation is to produce a small amount of large water drops. Likewise, the second stream 6 is mixed with a wash water stream 45 in the second mixing valve 200 resulting in a second oil/water stream 10. The wash water in stream 45 comes from the same source as stream 35. In an embodiment, the second mixing valve has a high pressure drop. Again, the actual values of the pressure drop are dependent on crude oil and water properties. Addition of more valves are not expected to significantly improve drop coalescence rates. The first oil/water stream 8 and the second oil/water stream 10 are combined resulting in a mixed oil/water stream 12. The mixed oil/water stream 12 is routed to a separator vessel 300. Vessel 300 removes a substantial portion of the salt content absorbed by the fresh water by electrostatically treating the mixed oil/water stream 12. The electric field promotes collision between drops, which leads to the formation of larger drops. When drops are sufficiently large, gravity forces the drops to settle to the bottom of the vessel 300. Thus, vessel 300 can be considered a gravity-based separation device, enhanced by the application of the electric field. In an embodiment, the vessel is a desalter. Treated oil is extracted from vessel is removed from an upper portion of the vessel 300. While water and salt are removed from a lower portion of the vessel 300.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A method for reducing a salt content of crude oil comprising:

a. dividing the crude oil stream into a first stream and a second stream;

b. mixing the first stream with a wash water stream resulting in a first oil/water stream;

c. mixing the second stream with a wash water stream resulting in a second oil/water stream;

d. combining the first oil/water stream and the second oil/water stream resulting in a mixed oil/water stream;

e. routing the mixed oil/water stream to a separator vessel whereby at least a substantial portion of the salt content is absorbed by water in the mixed oil/water stream;

f. electrostatically treating the mixed oil/water stream in the separator vessel;

g. extracting water from a lower portion of the separator vessel; and h. extracting treated oil from an upper portion of the separator vessel.

2. The method according to claim 1, wherein a first mixing valve is used to mix the first stream with the wash water stream.

3. The method according to claim 2, wherein the first mixing valve has a low pressure drop.

4. The method according to claim 1, wherein the second mixing valve is used to mix the second stream with the wash water stream.

5. The method according to claim 4, wherein the second mixing valve has a high pressure drop.

6. A method for reducing a salt content of crude oil comprising:

a. dividing the crude oil stream into a first stream and a second stream;

b. routing the first stream to a first mixing valve, wherein the first stream is mixed with a wash water stream resulting in a first oil/water stream, wherein the first mixing value has a low pressure drop resulting in large drops of water in oil;

c. routing the second stream to a second mixing valve, wherein the second stream is mixed with a wash water stream resulting in a second oil/water stream, wherein the second mixing valve has a high pressure drop resulting in a small drops of water in oil;

d. combining the first oil/water stream and the second oil/water stream resulting in a mixed oil/water stream;

e. routing the mixed oil/water stream to a separator vessel whereby at least a substantial portion of the salt content is absorbed by water in the mixed oil/water stream;

f. electrostatically treating the mixed oil/water stream in the separator vessel;

g. extracting water from a lower portion of the separator vessel; and h. extracting treated oil from an upper portion of the separator vessel.

* * * * *